United States Patent [19]

Kato

[11] Patent Number: 4,844,444

[45] Date of Patent: Jul. 4, 1989

[54] ROLL FEED APPARATUS

[75] Inventor: Heizaburo Kato, Shizuoka, Japan

[73] Assignee: Sankyo Manufacturing Company, Ltd., Tokyo, Japan

[21] Appl. No.: 157,029

[22] Filed: Feb. 18, 1988

[30] Foreign Application Priority Data

Apr. 24, 1987 [JP] Japan ..... 62-101650

[51] Int. Cl.[4] ..... B65H 5/10

[52] U.S. Cl. ..... 271/268; 271/272; 271/115; 226/142; 226/146; 226/162

[58] Field of Search ..... 271/272, 273, 266, 267, 271/268, 84, 264; 226/137, 148, 149, 151, 154, 162

[56] References Cited

U.S. PATENT DOCUMENTS

| | | | |
|---|---|---|---|
| 2,946,588 | 7/1960 | Pityo | 226/154 X |
| 4,029,251 | 6/1977 | Johnson | 226/154 |
| 4,415,108 | 11/1983 | Katoh | 226/154 X |
| 4,549,683 | 10/1985 | Kato | 226/154 X |
| 4,601,420 | 7/1986 | Kato | 226/154 |
| 4,634,034 | 1/1987 | Kato | 226/154 X |
| 4,638,990 | 1/1987 | Kato | 271/272 |
| 4,638,991 | 1/1987 | Kato | 271/272 |

FOREIGN PATENT DOCUMENTS 32150 2/1986 Japan .

*Primary Examiner*—Kevin P. Shaver
*Assistant Examiner*—David H. Bollinger
*Attorney, Agent, or Firm*—Pollock, Vande Sande & Priddy

[57] ABSTRACT

A roll feed apparatus has first and second rolls for gripping a plate when rotated in first directions and moving from each other when rotated in second directions, and first and second brake pieces for fixing the plate during rotation in the second direction. A pivot body has support portions along its length for rotatably supporting a first roll shaft at opposite ends. A pair of pivot shafts parallel to the first roll shaft are rotatably connected to the pivot body and a housing and eccentric with respect to each other. First and second adjusting arms are fixed to the shafts; third and fourth adjusting arms are pivotally fitted to the support portions and support the first brake piece. A first adjusting device with first and second links coupled to the first and second adjusting arms moves portions of the first roll and first brake piece located next to first and second arms towards or away from the second roll and the second brake piece by pivoting these arms. Third and fourth links coupled to the third and fourth arms move portions of the first brake piece located next to third and fourth arms with respect to the second brake by pivoting these arms. A second adjusting device moves the first roll and the first brake piece in parallel with respect to the second roll and second brake piece by pivoting the pivot body.

4 Claims, 5 Drawing Sheets

ROLL FEED APPARATUS

BACKGROUND OF THE INVENTION

1. Field of the Invention

The present invention relates to a roll feed apparatus used to feed plates intermittently to an industrial machine such as a press.

2. Description of the Prior Art

Japanese Utility Model Laid-Open No. 61-32150 (Utility Model Application No. 59-114306) discloses a roll feed apparatus which includes: first and second rolls fixed to first and second roll shafts, respectively, the rolls being adapted to grip a plate and thereby convey it when they are rotated in first directions and being moved away from each other so as to loosen the grip when rotated in second or opposite directions; and first and second brake pieces disposed on both sides of a plate passageway in such a manner as to face each other, for fixing the plate when the two rolls are rotated in the second directions. In the roll feed apparatus of this type, in order to increase the accuracy with which the plate is conveyed without sliding, it is necessary that the gap between the two rolls is suitably adjusted in accordance with the thickness of the plate. When the plate to be conveyed has a thickness which changes in the lateral direction, it is desirable to change the gap between the two rolls in the axial direction thereof to cope with the change in thickness of the plate in the lateral direction. In the above-described known roll feed apparatus, these objects are attained by the provision of a first roll shaft whose both ends are rotatably mounted in a housing with eccentric flanges therebetween. Rotation of the eccentric flanges moves, together with the first roll shaft, the two ends of the first roll toward or away from the second roll.

The known apparatus, however, suffers from problems in that the rotation of the eccentric flanges requires the time-consuming process of removing a cover and unscrewing bolts, because the eccentric flanges are fixed to the housing by bolts and because they are covered with the cover, and that the operation of the roll feed apparatus must be stopped during this process. Further, since the eccentric flanges are tightly fitted to the first roll shaft and the housing, they must be hit by a hammer to make them rotate, making the rotation of the flanges time-consuming and making fine adjustment of the gap between the two rolls difficult.

SUMMARY OF THE INVENTION

Accordingly, an object of the present invention is to provide a roll feed apparatus which is capable of conveying a plate with a high level of accuracy by a suitable adjustment of the gaps between two rolls and two braking pieces, and which enables this adjustment to be carried out without stopping the operation of the apparatus.

To this end, the present invention provides a roll feed apparatus which comprises: a pivot body having support portions for rotatably supporting portions of a first roll shaft which are located at both ends of a first roll, the support portions being positioned between one end and the other end of the pivot body; a pair of pivot shafts extending parallel to the first roll shaft on both sides of the pivot body, the pivot shafts being rotatably fitted to the one end of the pivot body and a housing of the roll feed apparatus in an eccentric relationship; first and second adjusting arms fixed to the corresponding pivot shafts; third and fourth arms pivotally fitted to the corresponding support portions on the both sides of the pivot body, the third and fourth arms supporting a first brake piece; a first adjusting device having first and second links, respectively, coupled to the first and second adjusting arms, for moving the corresponding portions of the first roll and the first brake piece which are located at the sides of the first and second adjusting arms toward or away from a second roll and a second brake piece through substantially the same distance through the pivoting of the first and second adjusting arms, and third and fourth links, respectively, coupled to the third and fourth adjusting arms for moving the corresponding portions of the first brake piece which are located at the sides of the third and fourth adjusting arms toward or away from the second brake piece through the pivoting of the third and fourth adjusting arms; and a second adjusting device coupled to the free end of the pivot body for moving the first roll and the first brake piece in parallel toward or away from the second roll and the second brake piece by the pivoting of the pivot body.

In the present invention, when the first, second, third, and fourth adjusting arms of the first adjusting device are suitably pivoted, the corresponding sides of the first roll and the corresponding sides of the first brake piece, when looking in the direction of the axis of the first roll, are moved toward or away from the second roll and the second brake piece through substantially the same distance, and the corresponding sides of the first brake piece, when looking in the direction of the axis of the first roll, are moved toward or away from the second brake piece without moving the first roll with respect to the second roll. Further, the first roll and the first brake piece are moved in parallel toward or away from the second roll and the second brake piece by the second adjusting device. In consequence, the gap between the two rolls and the gap between the two brake pieces can be suitably adjusted in accordance with the plate to be conveyed by suitably operating the first and second adjusting device.

DESCRIPTION OF THE PREFERRED EMBODIMENTS

Figure 1:
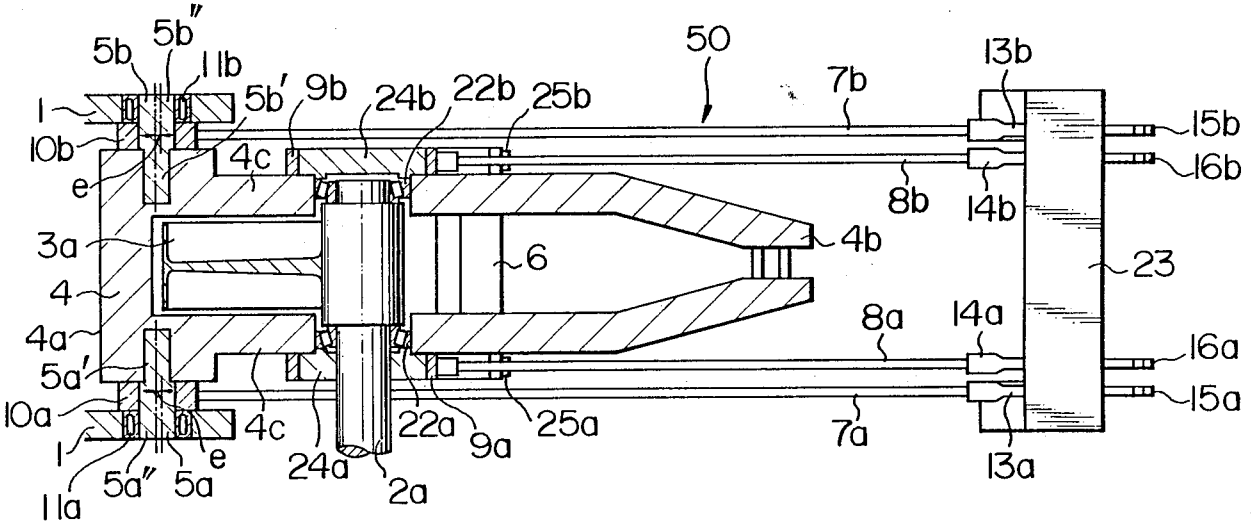
FIG. 1 is a partially cross-sectional view of a first embodiment of the present invention, showing a roll feed apparatus as viewed from above.
Figure 2:
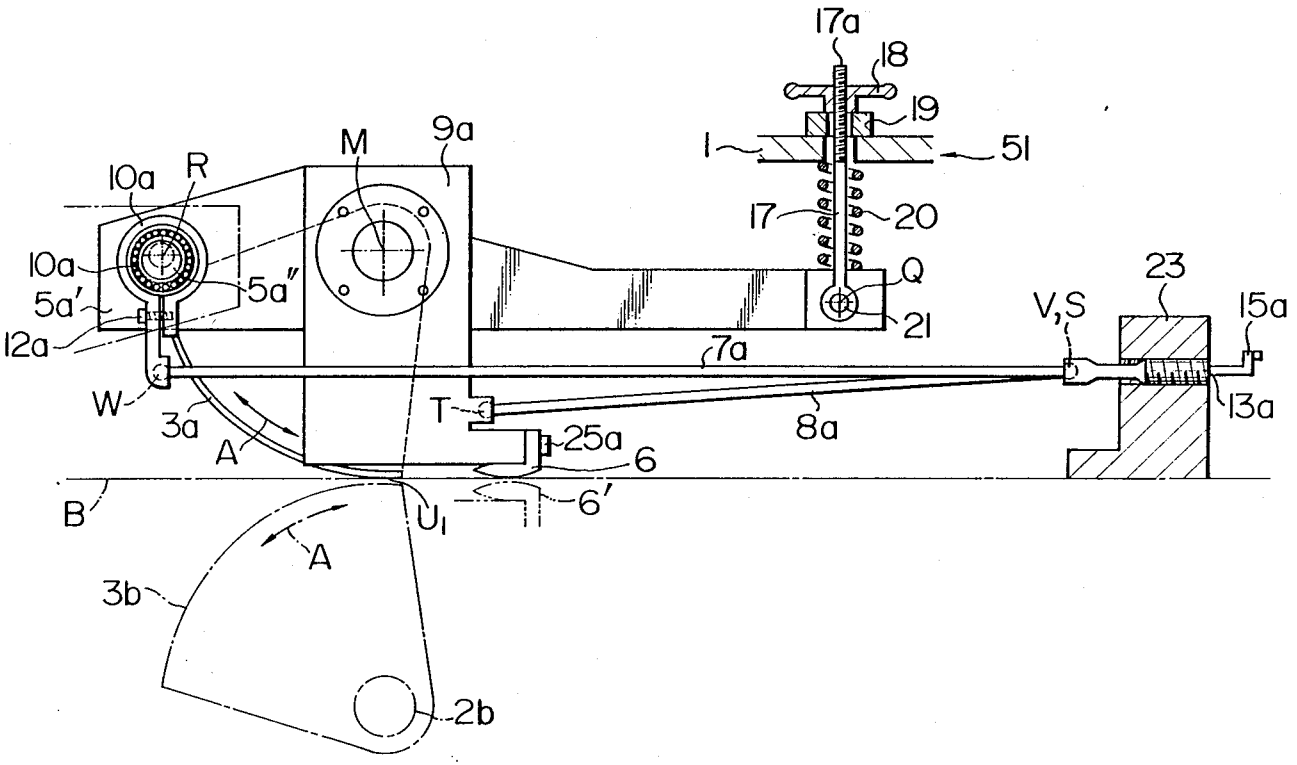
FIG. 2 is a front view of the roll feed apparatus of FIG. 1.
Figure 3:
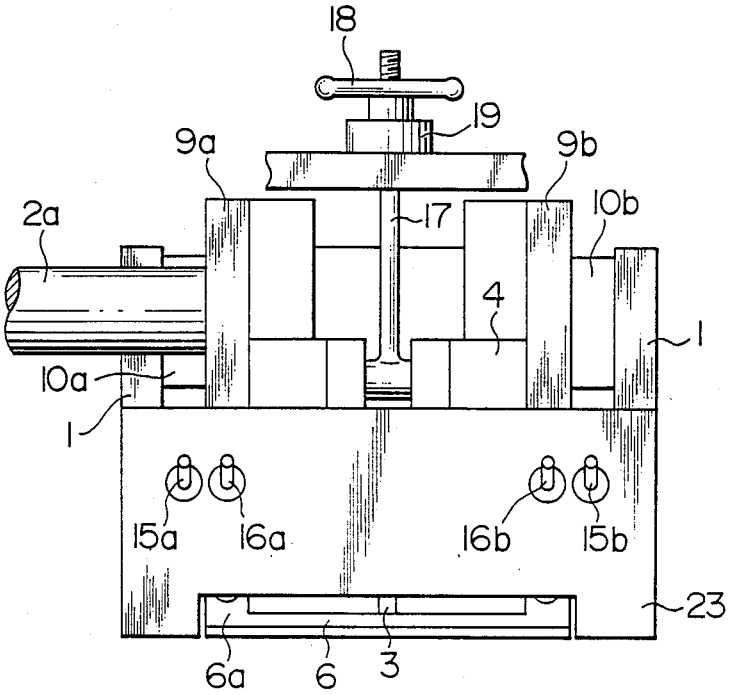
FIG. 3 is a side elevational view of the apparatus of FIG. 1.

FIGS. 1 to 3 show an embodiment of a roll feed apparatus according to this invention. This roll feed apparatus is of the type which includes: a first roll 3*a* and a second roll 3*b* fixed to a first roll shaft 2*a* and a second roll shaft 2*b*, respectively, in such a manner as to be rotatable in the directions indicated by A, the first and second rolls being adapted to grip a plate and thereby conveying it when they are rotated in first directions and being relatively moved away from each other so as to loosen the grip when rotated in second directions; and a first brake piece 6 and a second brake piece 6' disposed on two sides of a plate passageway B in such a manner as to face each other, the first and second brake pieces relatively moving toward each other so as to grip the plate when the two rolls are rotated in the second directions, the first and second brake pieces moving away from each other so as to release the grip of the plate when the two rolls are rotated in the first directions. Since the roll feed apparatus of this type is known in the art and is disclosed in, for example, the specification of Japanese Utility Model Laid-Open No. 61-32150, a drive device for rotating the two rolls, a mechanism for moving the two rolls toward and away from each other, and a mechanism for moving the two braking pieces toward and away from each other have also been known and the known ones can be used in the present invention, its description, therefore is being omitted.

The roll feed apparatus has a pivot body 4 which is pivotally mounted at one end thereof 4*a* on a housing 1 of the roll feed apparatus through pivot shafts 5*a* and 5*b*. The pivot body 4 has support portions 24*a* and 24*b* between the one end 4*a* and the end 4*b* thereof to support the first roll shaft 2*a*. The pivot shafts 5*a* and 5*b* are provided on two opposite sides (for example at upper and lower sides as viewed in FIG. 1) of the one end 4*a*, and extend in an aligned relationship parallel to the first roll shaft 2*a*. The pivot shafts 5*a* and 5*b* respectively have small diameter portions 5*a'* and 5*b'* and large diameter portions 5*a''* and 5*b''* in an eccentric relationship by a predetermined dimension with the small diameter portions 5*a'* and 5*b'*. The small diameter portions 5*a'* and 5*b'* are rotatably fitted to the pivot body 4, and the large diameter portions 5*a''* and 5*b''* are rotatably fitted to the housing 1 through bearings 11*a* and 11*b*. A first adjusting arm 10*a* is fitted onto the pivot shaft 5*a* located at a lower side as viewed in FIG. 1 and is fixed thereto by a bolt 2*a*. Similarly, a second adjusting arm 10*b* is fitted onto the pivot shaft 5*b* located at an upper side as viewed in FIG. 1, and is fixed thereto by a bolt (not shown).

The support portions 24*a* and 24*b* of the pivot body 4 comprise flange members fixed to two sides of a body 4*c* of the pivot body 4 (to upper and lower sides as viewed in FIG. 1). The support portion 24*a* rotatably supports through a bearing 22*a* a portion of the first roll shaft 2*a* which projects toward the lower side as viewed in FIG. 1 from the first roll 3*a*, and the support portion 24*b* rotatably supports through a bearing 22*b* a portion of the first roll shaft 2*a* which projects toward the upper side as viewed in FIG. 1 from the first roll 3*a*. A third adjusting arm 9*a* and a fourth adjusting arm 9*b* are pivotally fitted onto the lower and upper support portions 24*a* and 24*b*, respectively. The first brake piece 6 extends between the third and fourth adjusting arms 9*a* and 9*b*, and are fixed to the lower ends of the arms 9*a* and 9*b* by bolts 25*a* and 25*b*, respectively.

The first, second, third, and fourth adjusting arms are coupled to a first adjusting device 50. More specifically, the first adjusting device 50 has a first link 7*a* pivotally coupled to the first adjusting arm 10*a* at one end, a second link 7*b* pivotally coupled to the second adjusting arm 10*b* at one end, a third link 8*a* pivotally coupled to the third adjusting arm 9*a* at one end, and a fourth link 8*b* pivotally coupled to the fourth adjusting arm 9*b*. The other end, for example, the right end as viewed in FIGS. 1 and 2, of the first link 7*a* is pivotally retained by the inner end, i.e., the left end as viewed in FIGS. 1 and 2, of a screw member 13*a* threadingly engaged with a fixed block 23 and having a pivot handle 15*a* at the outer end thereof, i.e., at the right end as viewed in FIGS. 1 and 2. Similarly, the other ends of the second, third, and fourth links 7*b*, 8*a*, and 8*b* are pivotally retained by the inner ends of screw members 13*b*, 14*a*, and 14*b* threadingly engaged with the fixed block 23 and having pivot handles 15*b*, 16*a* and 16*b* at the outer ends thereof, respectively.

The first adjusting arm 10*a* and second adjusting arm 10*b* are disposed in a symmetrical manner with respect to the pivot body 4. Similarly, the third adjusting arm 9*a* and the fourth adjusting arm 9*b* are disposed in a symmetrical manner with respect to the pivot body 4. The first adjusting arm 10*a*, the first link 7*a*, the third adjusting arm 9*a*, and the third link 8*a* are relatively arranged in the same manner as that in which the second adjusting arm 10*b*, the second link 7*b*, the fourth adjusting arm 9*b*, and the fourth link 8*b* are relatively arranged.

The other end 4*b* (the right end as viewed in FIGS. 1 and 2) of the pivot body 4 is coupled to a second adjusting device 51. The second adjusting device 51 has a screw rod 17 which extends through the housing. An inner end of the screwed rod 17 is pivotally coupled to the pivot body 4 by a pin 21, and the outer end thereof is threaded to form a threaded portion 17*a*. The screw rod 17 is fixed to the housing 1 by a spring 20 disposed between the housing 1 and the pivot body 4 in such a manner as to surround the screw rod for urging the rod 17 downward (as viewed in FIG. 2) toward the right end of the pivot body 4 and by a handle 18 threadingly engaged with the threaded portion 17*a* for pressing a spacer 19 against the outer surface of the housing 1.

Figure 4:
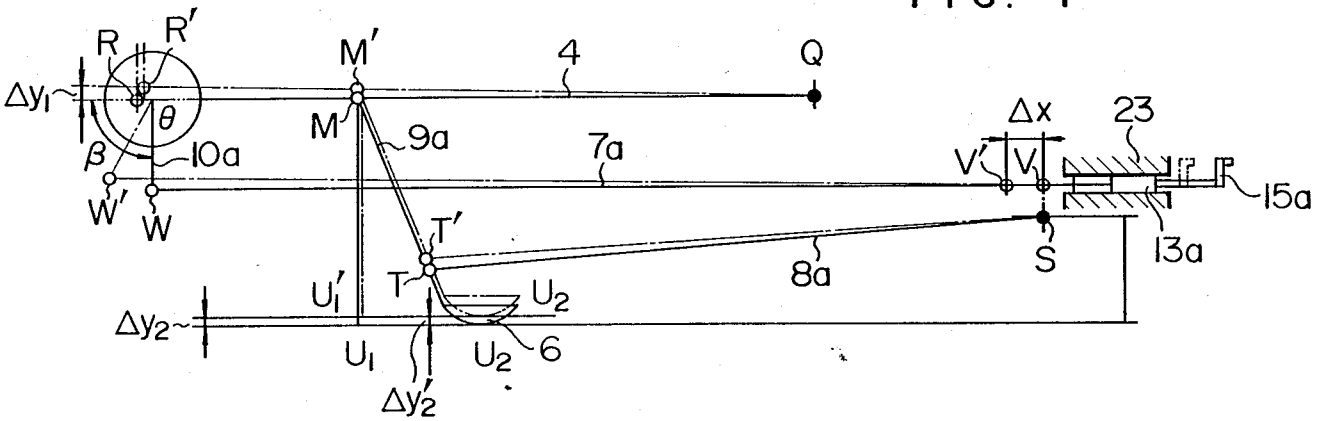
FIGS. 4 and 5 illustrate the operation of a first adjusting device.

When the screw member 13*a* is moved leftwards with respect to the fixed block 23 through, for example, $\Delta x$ from a position indicated by the solid line in FIG. 4 by turning the pivot handle 15*a*, the components of the apparatus are positioned as shown by the dot-dashed line in FIG. 4. More specifically, the connection V of the first link 7*a* and the screwed member 13*a* is moved leftwards to a position indicated by V', and the first link 7*a* accordingly pivots the first adjusting arm 10*a* and the pivot shaft 5*a* which are integral with the arm 10*a* clockwise as viewed in FIG. 4 through the connection W of the first link 7*a* and the first adjusting arm 10*a*. As has been described previously, since the small diameter portion 5*a'* and the large diameter portion 5*a''* of the pivot shaft 5*a* are in an eccentric relationship and the pivot shaft 5*a* pivots with respect to the housing 1 to which it is fixed about the axis of the large diameter portion 5*a''*, the pivot of the pivot shaft 5*a* causes a position R of the axis of the small diameter portion 5*a'* to displace to R', displacing the left end of the pivot body 4 upward through $\Delta y1$, for example, pivoting the pivot body 4 clockwise about a connection Q of the screwed rod 17 with the pivot body 4. This displaces a position M of the intersection point of the pivot body 4 and the first roll shaft 2*a* to M', and raises the lowermost point Ul of the first roll 3*a* through $\Delta y2$ to Ul'. At this time, since the third link 8*a* is pivoted clockwise about a connection S of the right end of the third link 8*a* with the screw member 14*a*, a connection T of the left end of the third link 8*a* and the third adjusting arm 9*a* rises to T', raising a lowermost point U2 of the first braking piece 6 to U2' through $\Delta y2'$. As will be seen from the above description, operation of the pivot handle 15*a* raises or lowers the lowermost point U1 of the first roll 3*a* and the lowermost point U2 of the first braking piece 6 through substantially the same distance. In other words, the operation of the pivot handle 15*a* moves the first roll 3*a* and the first braking piece 6 toward or away from the second roll 3*b* and the second braking piece 6′ through the same distance. Further, when the third link 8*a* is moved rightwards, for example, through Δx1 from the position shown by the solid line in FIG. 5 to S′ by turning the pivot handle 16*a*, the third adjusting arm 9*a* is pivoted counterclockwise in FIGS. 2 and 5 with respect to the support portion 24*a* of the pivot body 4 while the points Q, R, M, and Ul remain unchanged, moving the point T to T″ and raising the lowermost point U2 of the first braking piece 6 to U2″ through Δy3, as shown by the dot-dashed line in FIG. 5.

Turning of the handle 15*a* does not displace the support portion 24*b* of the pivot body 4 located at an upper side as viewed in FIG. 1 and the upper end (as viewed in FIG. 1) of the first roll shaft 2*a* supported by the support portion 24*b*, but changes the positions of the support portion 24*a* located at a lower side as viewed in FIG. 1 and the lower end of the second roll shaft 2*a* supported by the support portion 24*a* towards front or back side as viewed in FIG. 1. Similarly, it does not change the position of the end of the first braking piece 6 which is located at an upper side as viewed in FIG. 1 but displaces the lower end thereof toward front or back side as viewed in FIG. 1. Further, the operation of the pivot handle 16*a* does not change the position of the upper end (as viewed in FIG. 1) of the first brake piece 6 but displaces the lower end (as viewed in FIG. 1) thereof toward front or back side as viewed in FIG. 1.

As has been described above, since the first adjusting arm 10*a*, the first link 7*a*, the third adjusting arm 9*a*, and the third link 8*a* are relatively arranged in the same manner as that in which the second adjusting arm 10*b*, the second link 7*b*, the fourth adjusting arm 9*b*, and the fourth link 8*b* are relatively arranged, when the handle 15*b* is turned, the first roll 3*a* and the first brake piece 6 are respectively moved towards or away from the second roll 3*b* and the second brake piece 6′ in the similar manner to that shown in FIG. 4. When the handle 16*b* is turned, the first brake piece 6 alone is moved towards or away from the second brake piece 6′ while the first roll 3*a* remains fixed. Thus, the turning of the pivot handles 15*b* and 16*b* displaces the upper ends of the first roll shaft 2*a* and the first brake piece 6 towards front or back side as viewed in FIG. 1 in the state wherein the lower ends thereof remain fixed, the direction of the displacement depending on the direction in which the handles 15*b* and 16*b* are turned. As a result, by suitably turning the four handles 15*a*, 15*b*, 16*a*, and 16*b*, the gap between the two rolls and the gap between the two brake pieces can be adjusted in such a manner that they are equal, and they can also be adjusted in the axial direction of the two rolls, for example, in the lateral direction of the plate. This results in efficient conveyance and fixing of the plate by the two rolls and two brake pieces, even if the plate has a thickness which varies in the lateral direction thereof.

Figure 6:
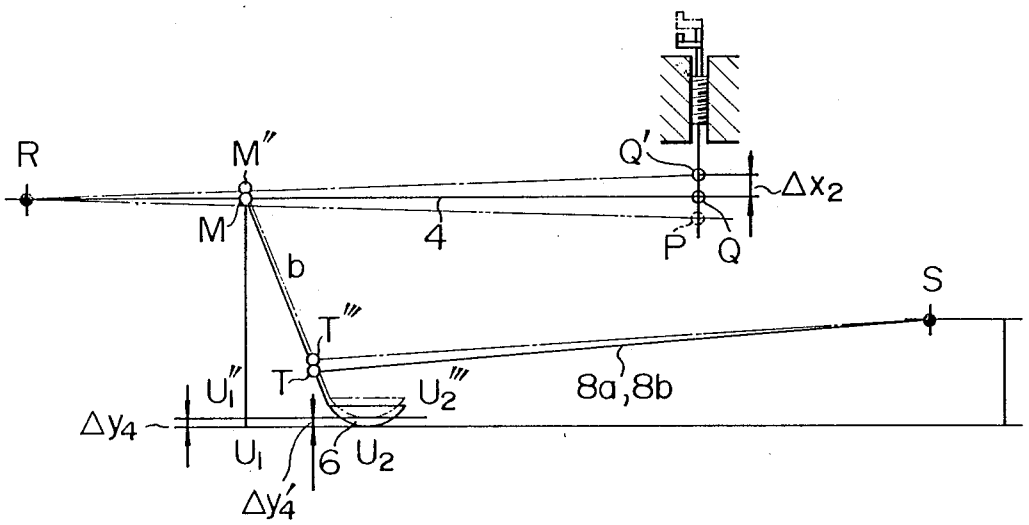
FIG. 6 illustrates the operation of a second adjusting device.

When the screwed rod 17 is displaced by the turn of the handle 18 of the second adjusting device 51, for example, from the position indicated by the solid line in FIG. 6 to the position indicated by the dot-dashed line through Δx2, the point Q is displaced to Q′, pivoting the pivot body 4 counterclockwise about the point R. This raises the points M, Ul, T, and U2 to M″, U1″, T‴, and U2‴, respectively, moving the first roll 3*a* and the first brake piece 6 parallel with respect to the second roll 3*b* and the second brake piece 6′ through the same distances of Δy4 and Δy4′ while they are maintained in the state obtained by adjusting the first adjusting device 50. In consequence, if the gaps formed between the two rolls and the two brake pieces are set to suitable values in accordance with the thickness of the plate to be conveyed by the second adjusting device 51 in addition to the above-described adjustment by the first adjusting device 50, suitable adjustment of the gaps is effected under various conditions, enabling the plate to be conveyed with a high level of accuracy. Furthermore, since the handles 15*a*, 15*b*, 16*a*, and 16*b* and the handle 18 are exposed to the outside, the above adjustment can be effected by a simple operation of turning these handles, without stopping the operation of the roll feed apparatus.

Figure 5:
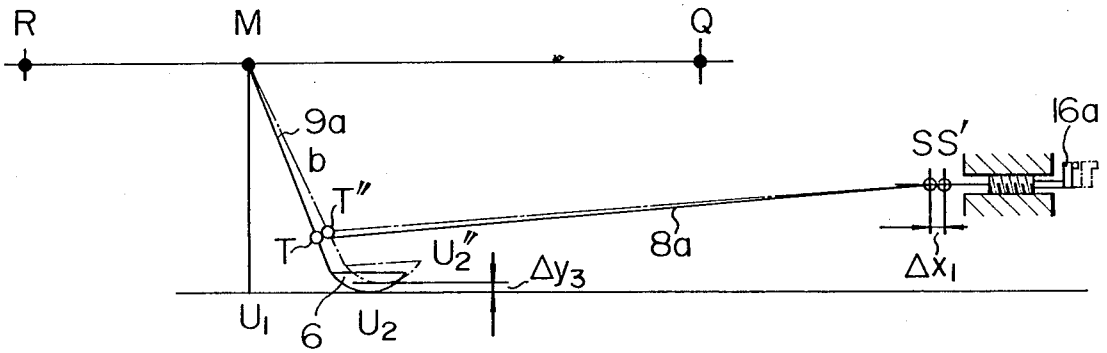

As will be understood from the foregoing description taken in conjunction with FIGS. 4, 5, and 6, the above-described movement of the points Ul and U2 can be obtained by suitably designing the relative positions of points S, V, Ul, U2, T, M, Q, and R and the eccentricity of the pivot shafts 5*a* and 5*b*. Although such a design is readily attainable to those skilled in the art, and its detailed description is therefore omitted, the following description schematically illustrates how to obtain Δy2, (Δy2′), Δy3, Δy4 (Δy4′), and Δyl, using the parameters shown in FIGS. 4 to 6.

As can be understood from the foregoing description, FIG. 4 shows the state in which the point R is displaced to R′ through--yl by the turning of the pivot handle 15*a* while the points S and Q (the point Q being slightly moved in the horizontal direction) are fixed, so as to move the position Ul of the lower end of the first roll through Δy2 and the position U2 of the lower end of the first brake piece through Δy2′.

Assuming that the point Q is located on a horizontal line which passes through a reference point N in FIG. 4:

$\rho_{V\theta}$ is known.

Therefore:

$$\rho_{VW} = \rho_{V\theta} + \rho_{\theta W}$$

(where the lower point is selected from the intersections of two circles) and $$\rho_{\theta R} = \gamma_{\theta R} e^{j(\theta_{\theta W} + \beta)}$$

Further, $\rho_{N\theta}$ is known, so:

$$\rho_{NR} = \rho_{N\theta} + \rho_{\theta R}$$

$$\rho_{NQ} = \rho_{NR} + \rho_{RQ}$$

(where the right intersection is selected from the intersections of the circle with the straight line)

$$\rho_{VR} = \rho_{V\theta} + \rho_{\theta R} \quad \rho_{RM} = \frac{\gamma_{RM}}{\gamma_{RQ}} \rho_{RQ}$$

$$_{VM} = \rho_{VR} + \rho_{RM} \text{ and } \rho_{VT} = \rho_{VM} + \rho_{MT}$$

$$\rho_{\theta R'} \text{ and } \rho_{V'T} \text{ for } V'$$

(which is moved from the point V) can be obtained in a similar manner. Then Δyl and Δy2′ can be obtained from these results. The displacement Δy2, through which the position Ul of the lower end of the first roll is moved, is equivalent to the displacement through which M is moved to M', and is expressed by:

$$\Delta y2 = \frac{\gamma QM}{\gamma RQ} \Delta y1.$$

Thus, the above-described operation is enabled by setting the components in such a manner that the two displacements (Δy2 and Δy2') are equal.

In FIG. 5, while the point M is maintained fixed, the point S is displaced through Δxl by the turning of the handle 16a, so as to move the position Ul of the lower end of the first brake piece through Δy3. In FIG. 5, if the point S is given, $\rho_{SM}$ can be defined, i.e., $\rho_{ST} = \rho_{SM} + \rho_{MT}$ (where the left intersection is selected from the intersections of the two circles). Similarly, when the point S is moved to S', $\rho_{S'M}$ can be defined, i.e., $\rho_{S'T''} = \rho_{S'M} + \rho_{MT''}$(where the left intersection is selected from the intersections of the two circles). Therefore, Δy3 can be obtained from $\rho_{ST}$ and $\rho_{S'T''}$.

Next, in FIG. 6, the point Q is displaced through ΔX2 by the turning of the handle 18 while the points R and S remain fixed, so as to change the position Ul of the lower end of the first roll through Δy4 and the position U2 of the lower end of the first braking piece through Δy4'. If the components are set in such a manner that Δy4 and Δy4' are equal, the thickness of the plate can be changed while the positional relationship between the lower ends of the roll and the brake remains unchanged. More specifically, a virtual point P is defined on the line passing through Q and Q', and $\rho_{RP}$ is set to $\gamma_{RP}\rho^{j\theta}$RP. If the coordinates of Q are given, $\rho_{PQ}$ is determined.

Therefore, $$\rho_{RQ} = \rho_{RP} + \rho_{PQ} \text{ and } \rho_{RM} = \frac{\gamma RM}{\gamma RQ} \rho_{RQ}.$$

Since the point S is fixed, $_{SM}$ is expressed as a vector connecting S and M by: $_{SM} = {}_{RM}$ and $_{ST} = {}_{SM} + {}_{MT}$ (where the left intersection is selected from the two intersections of the two circles). Similarly, the vector for Q', which is moved from Q through ΔX2, is expressed by:

$$\rho_{PQ'} = \gamma_{PQ}\rho^{j\theta}\text{PQ} = (\gamma_{PQ} + \Delta X2)\rho^{j\theta}\text{PQ}.$$

Therefore:

$$\rho_{RQ'} = {}_{RP} + \rho_{PQ'}$$

$$\rho_{RM''} = \frac{\gamma RM}{\gamma RQ} \rho_{RQ'}$$

$$\rho_{SM''} = \rho_{SR} + {}_{RM''}, \text{ and}$$

$$\rho_{ST''} = \rho_{SM''} + \rho_{M''T''}$$

(where the left intersection is selected from the intersections of the two circles).

As a result, Δy4' can be obtained from $\rho_{ST}$ and $\rho_{ST''}$. The displacement Δy4 of the position Ul of the lower end of the roll is equivalent to the displacement between M and M'', and is expressed by:

$$\Delta y4 = \frac{\gamma RM}{\gamma RQ} \Delta X2.$$

The above-described change in the thickness of the plate can be attained by setting the components in such a manner that the displacements (Δy4 and Δy4') are equal.

As will be understood from the foregoing description, it is possible to convey the plate with a high level of accuracy according to the present invention by adjusting the gap between the two rolls and the gap between the two brake pieces to suitable values in accordance with the thickness of the plate, this adjustment including adjustment of the gaps in accordance with the thickness of a plate which changes in the lateral direction thereof. It is also possible to conduct such an adjustment without stopping the operation of the roll feed apparatus.

What is claimed is:

1. A roll feed apparatus including:

first and second rolls fixed to first and second roll shafts, respectively, said rolls being adapted to grip a plate and thereby convey it when said rolls are rotated in first directions and being movable away from each other such as to loosen the grip when rotated in second directions;

first and second brake pieces disposed to face each other on both sides of a plate passageway, said first and second brake pieces fixing said plate when said two rolls are rotated in said second directions;

a pivot body having a first and a second end and a top and a bottom part, said pivot body including support portions positioned along said top and bottom parts for rotatably supporting said first roll shaft at two opposite ends thereof substantially perpendicular to said top and bottom parts;

a pair of pivot shafts extending substantially parallel to said first roll shaft at said first end at said top and bottom part of said pivot body, respectively, one of said pivot shafts being rotatably fitted to said pivot body and the other pivot shaft to a housing of said roll feed apparatus, said pivot shafts being eccentric with respect to each other;

first and second adjusting arms, each arm fixed to one of said pivot shafts, respectively;

third and fourth adjusting arms, each arm pivotally fitted to one of said support portions on said top and bottom sides of said pivot body, said third and fourth adjusting arms supporting said first brake piece;

a first adjusting device having first and second links respectively couple to said first and second adjusting arms, for moving portions of said first roll and said first brake piece, which are located at the side of said first and second adjusting arms, towards or away from said second roll and said second brake piece through substantially the same distance, through pivoting said first and second adjusting arms, and third and fourth links respectively coupled to third and fourth adjusting arms for moving portions of said first brake piece, which are located at the sides of said third and fourth adjusting arms, towards or away from said second brake through pivoting of said third and fourth adjusting arms; and a second adjusting device coupled to said second end of said pivot body for moving said first roll and said first brake piece in parallel towards or away from said second roll and said second brake piece through pivoting of said pivot body.

2. A roll feed apparatus according to claim 1, wherein said first adjusting device has a fixed block and four screw members threadingly engaged with said fixed block, each of said screw members having a pivot handle at an outer end thereof, each of the inner ends of said screw members rotatably retaining one end of said first, second, third, or fourth link, such that said first, second, third, and fourth adjusting arms are pivoted by the displacement of said corresponding links caused by the rotation of said corresponding screw members.

3. A roll feed apparatus according to claim 1, wherein said second adjusting device has a screw rod extending through said housing, the inner end of said screw rod being rotatably coupled to said second end of said pivot body, the outer end of said screw rod including a threaded portion, a spring provided between said pivot body and said housing to surround said screw rod, and a handle threadingly engaged with said threaded portion of said screw rod for fixing said screw rod to said housing, such that rotation of said handle causes pivoting of said pivot body.

4. A roll feed apparatus according to claim 2, wherein said second adjusting device has a screw rod extending through said housing, the inner end of said screw rod being rotatably coupled to said second end of said pivot body, the outer end of said screw rod including a threaded portion, a spring provided between said pivot body and said housing to surround said screw rod, and a handle threadingly engaged with said threaded portion of said screw rod for fixing said screw rod to said housing, such that rotation of said handle causes pivoting of said pivot body.

* * * * *